US009651980B2

(12) United States Patent
Roy

(10) Patent No.: US 9,651,980 B2
(45) Date of Patent: May 16, 2017

(54) BANDGAP VOLTAGE GENERATION

(71) Applicant: Texas Instruments Incorporated, Dallas, TX (US)

(72) Inventor: Subrato Roy, Bangalore (IN)

(73) Assignee: Texas Instruments Incorporated, Dallas, TX (US)

( * ) Notice: Subject to any disclaimer, the term of this patent is extended or adjusted under 35 U.S.C. 154(b) by 1 day.

(21) Appl. No.: 14/664,803

(22) Filed: Mar. 20, 2015

(65) Prior Publication Data

US 2016/0274616 A1 Sep. 22, 2016

(51) Int. Cl.
*G05F 3/30* (2006.01)
*G05F 3/26* (2006.01)

(52) U.S. Cl.
CPC ..... *G05F 3/267* (2013.01)

(58) Field of Classification Search
CPC ..... G05F 3/18; G05F 3/22; G05F 3/30; G05F 3/262; G05F 3/265; G05F 1/56
USPC ..... 323/311–317
See application file for complete search history.

(56) References Cited

U.S. PATENT DOCUMENTS 5,053,640 A 10/1991 Yum
5,451,860 A * 9/1995 Khayat ..... G05F 3/30 323/313
5,838,149 A * 11/1998 Perraud ..... H04M 19/08 323/315
6,294,902 B1 * 9/2001 Moreland ..... G05F 3/30 323/268
7,524,107 B1 4/2009 Lorenz
2002/0041531 A1 4/2002 Tanaka et al.
2007/0126495 A1 * 6/2007 Ivanov ..... G05F 3/30 327/539
2009/0108917 A1 * 4/2009 Chellappa ..... G05F 3/30 327/539
2011/0187445 A1 8/2011 Sicard
2015/0115929 A1 * 4/2015 Seth ..... G11C 5/147 323/303

FOREIGN PATENT DOCUMENTS

WO WO2013177425 A1 11/2013

OTHER PUBLICATIONS

Search Report for PCT/US16/23451, mailed Jun. 30, 2016 (2 pages).

* cited by examiner

*Primary Examiner* — Yemane Mehari
(74) *Attorney, Agent, or Firm* — Lawrence J. Bassuk; Charles A. Brill; Frank D. Cimino

(57) ABSTRACT

A bandgap reference voltage generator includes a first and a second bipolar junction transistor, which is biased at a lower current per unit emitter area than that of the first transistor. Accordingly, the base to emitter voltage of first transistor is higher than that of the second transistor and a delta VBE is generated at the base of the first transistor with respect to the base of the second transistor. A first voltage divider generates a divided voltage of a VBE (fractional VBE) at a first center node. The fractional VBE is added to the VBE of the first transistor and subtracted from the VBE of the second transistor by closed loop feedback action to generate a temperature compensated reference voltage at the base of second transistor. The reference voltage can be amplified to higher voltage levels by using a resistor divider at the base of second transistor.

11 Claims, 3 Drawing Sheets

BANDGAP VOLTAGE GENERATION

BACKGROUND

Many applications of integrated circuits are embodied within a highly integrated system such as a system-on-chip (SoC). In some of these applications, the SoCs are required to work from low supply voltages and to consume relatively low amounts of power. In such applications, the SoCs incorporate functions (such as a wakeup detect function) that are enabled during a sleep mode of the SoC. In such sleep modes, various battery or system monitoring applications are "on," and accordingly are designed to work from low voltages to save power. Almost all of these SoCs have a bandgap reference circuit to provide a constant voltage reference. Such bandgap reference circuits are typically required to have capability to generate accurate reference voltages even at low supply voltages.

SUMMARY

The problems noted above can be solved using a bandgap reference architecture which is operable over a wide range of supply voltages as low as approximately 1.1V. The disclosed bandgap reference voltage generator includes a first bipolar junction transistor (PNP1) and a second bipolar junction transistor (PNP2), which is biased at a lower current per unit emitter area than that of the first transistor. Accordingly, the base to emitter voltage of first transistor is higher than that of the second transistor, which generates a delta VBE (differential base-to-emitter voltage) signal. The delta VBE is generated at the base of the first transistor with respect to the base of the second transistor. A first voltage divider (e.g., resistor divider) generates a divided voltage of a VBE (fractional VBE) at a first center node. The fractional VBE is added to the VBE of PNP1 and subtracted from the VBE of PNP2 by closed loop feedback action to generate a temperature compensated reference voltage at the base of PNP2. The temperature compensate reference voltage can be amplified as required by using a second resistor divider whose center node is coupled to the base of PNP2.

This Summary is submitted with the understanding that it is not be used to interpret or limit the scope or meaning of the claims. Further, the Summary is not intended to identify key features or essential features of the claimed subject matter, nor is it intended to be used as an aid in determining the scope of the claimed subject matter.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be example of that embodiment, and not intended to intimate that the scope of the disclosure, including the claims, is limited to that embodiment.

Certain terms are used throughout the following description—and claims—to refer to particular system components. As one skilled in the art will appreciate, various names may be used to refer to a component or system. Accordingly, distinctions are not necessarily made herein between components that differ in name but not function. Further, a system can be a sub-system of yet another system. In the following discussion and in the claims, the terms "including" and "comprising" are used in an open-ended fashion, and accordingly are to be interpreted to mean "including, but not limited to . . . ." Also, the terms "coupled to" or "couples with" (and the like) are intended to describe either an indirect or direct electrical connection. Thus, if a first device couples to a second device, that connection can be made through a direct electrical connection, or through an indirect electrical connection via other devices and connections. The term "portion" can mean an entire portion or a portion that is less than the entire portion. The term "calibration" can include the meaning of the word "test." The term "input" can mean either a source or a drain (or even a control input such as a gate where context indicates) of a PMOS (positive-type metal oxide semiconductor) or NMOS (negative-type metal oxide semiconductor) transistor. The term "pulse" can mean a portion of waveforms such as "squarewave" or "sawtooth" waveforms.

Figure 1:
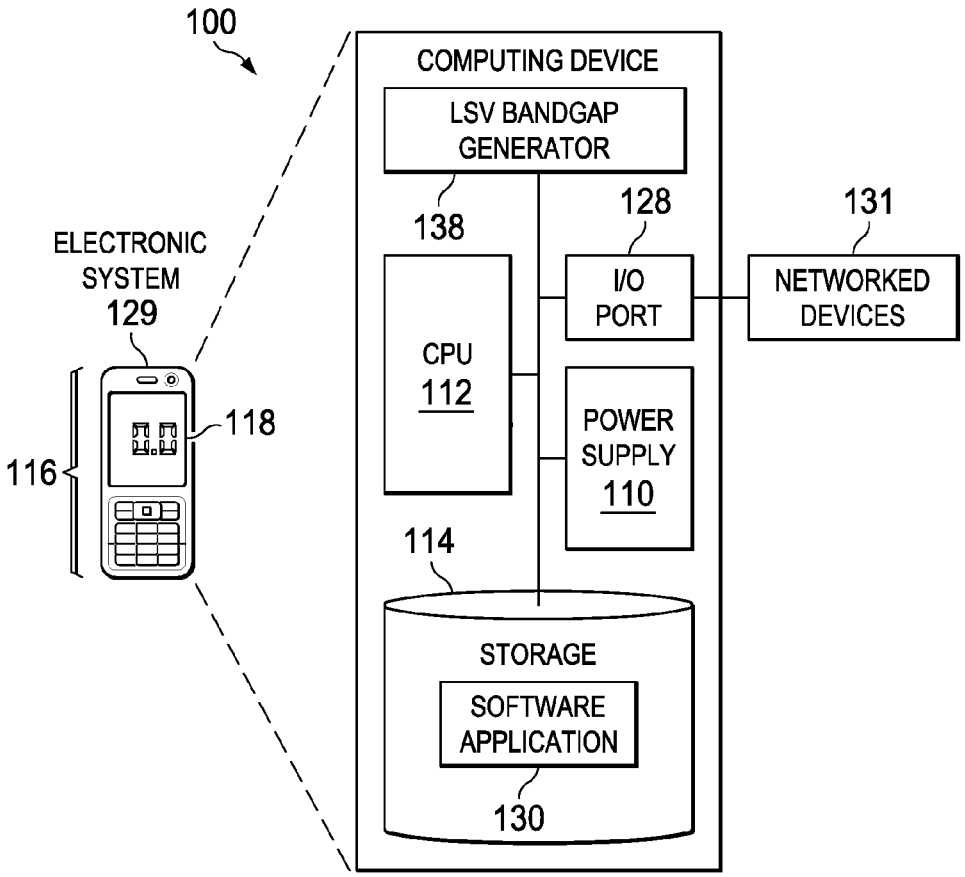
FIG. 1 shows an illustrative electronic device in accordance with example embodiments of the disclosure.

FIG. 1 shows an illustrative computing device 100 in accordance with embodiments of the disclosure. For example, the computing device 100 is, or is incorporated into, or is coupled (e.g., connected) to an electronic system 129, such as a computer, electronics control "box" or display, communications equipment (including transmitters or receivers), or any type of electronic system operable to process information.

In some embodiments, the computing device 100 comprises a megacell or a system-on-chip (SoC) which includes control logic such as a CPU 112 (Central Processing Unit), a storage 114 (e.g., random access memory (RAM)) and a power supply 110. The CPU 112 can be, for example, a CISC-type (Complex Instruction Set Computer) CPU, RISC-type CPU (Reduced Instruction Set Computer), MCU-type (Microcontroller Unit), or a digital signal processor (DSP). The storage 114 (which can be memory such as on-processor cache, off-processor cache, RAM, flash memory, or disk storage) stores one or more software applications 130 (e.g., embedded applications) that, when executed by the CPU 112, perform any suitable function associated with the computing device 100.

The CPU 112 comprises memory and logic that store information frequently accessed from the storage 114. The computing device 100 is often controlled by a user using a UI (user interface) 116, which provides output to and receives input from the user during the execution the software application 130. The output is provided using the display 118, indicator lights, a speaker, vibrations, and the like. The input is received using audio and/or video inputs (using, for example, voice or image recognition), and electrical and/or mechanical devices such as keypads, switches, proximity detectors, gyros, accelerometers, and the like.

The CPU 112 and power supply 110 are coupled to I/O (Input-Output) port 128, which provides an interface that is configured to receive input from (and/or provide output to) networked devices 131. The networked devices 131 can include any device (including test equipment) capable of point-to-point and/or networked communications with the computing device 100. The computing device 100 is often coupled to peripherals and/or computing devices, including tangible, non-transitory media (such as flash memory) and/or cabled or wireless media. These and other input and output devices are selectively coupled to the computing device 100 by external devices using wireless or cabled connections. The storage 114 is accessible, for example, by the networked devices 131. The CPU 112, storage 114, and power supply 110 are also optionally coupled to an external power supply (not shown), which is configured to receive power from a power source (such as a battery, solar cell, "live" power cord, inductive field, fuel cell, capacitor, and the like).

The power supply 110 comprises power generating and control components for generating power to enable the computing device 100 to execute the software application 130. For example, the power supply 110 provide one or more power switches, each of which can be independently controlled, that supply power at various voltages to various components of the computing device 100. The power supply 110 is optionally in the same physical assembly as computing device 100, or is coupled to computing device 100. The computing device 100 optionally operates in various power-saving modes (such as a sleep mode) wherein individual voltages are supplied (and/or turned off) in accordance with a selected power-saving mode and the various components arranged within a specific power domain.

The computing device 100 includes an LSV (low supply voltage) bandgap voltage reference generator 138. The disclosed bandgap reference architecture is capable of working over a wide supply voltage range that is as low as 1.1V. The disclosed architecture can be manufactured using ultra-deep sub-micron processes without deep n-well support.

Figure 2:
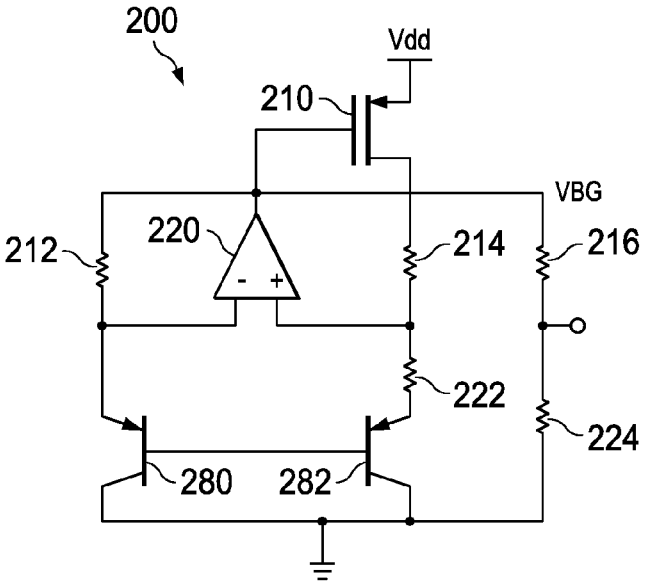
FIG. 2 (PRIOR ART)
FIG. 2 is a schematic of a bandgap circuit 200.

FIG. 2 is a schematic of a bandgap circuit 200. The bandgap circuit 200 includes PMOS transistor 210, resistors 212, 214, 216, 222, and 224, operational amplifier 220, and bipolar transistors 280 and 282. Circuit 200 generates a constant voltage by adding an amplified difference between the base-to-emitter voltage (VBE) of the bipolar transistor 280 and VBE of bipolar transistor 282 (e.g., "m*deltaVBE") to the VBE generated by bipolar transistor 280 to generate a temperature compensated reference voltage (VBG). The VBG signal is temperature compensated because the temperature coefficients of m*deltaVBE are ideally exactly equal and opposite to the temperature coefficients associated with VBE of transistor 280.

Bandgap circuit 200 is a first example bandgap architecture. The minimum voltage supply (Vdd) required to operate circuit 200 is VBE+m*dVBE+Vdsat, where m*dVBE is an amplified difference between base-to-emitter voltage (VBE) of the bipolar transistor 280 and VBE of bipolar transistor 282 and where Vdsat is the minimum source to drain voltage needed to keep transistor 210 in current saturation region of operation. VBE+m*dVBE is the typical bandgap voltage for Si which is approximately 1.23V. If a minimum Vdsat of 0.1V is required, the minimum operating Vdd is approximately 1.33V. Accordingly, circuit 200 is not well suited for operation with digital logic voltage supplies or with circuitry operating from a low voltage supply. Additionally, during startup of circuit 200, all the current from the PMOS transistor 210 will be flowing through resistor 216 over a certain range of PMOS gate voltages. For at least this reason, circuit 200 has multiple operating points (e.g., more than two operating points) and might not reach a correct operating point without additional control circuitry. An operating point is a point (e.g., for a given set of selected values of components of a circuit) in which a stable operating voltage is achieved by the circuit. A valid (e.g., correct) operating point is a point at which the circuit operates in accordance with its intended function. (Accordingly, an operating point can be valid or invalid depending on context.)

A second example bandgap architecture is the Banba architecture (not shown). The Banba bandgap architecture operates in a current (e.g., flow) domain (as compared to the voltage domain in which bandgap circuit 200 operates). The Banba bandgap architecture generates a constant voltage by adding the delta VBE dependent current to a correct proportion of the VBE dependent current and passing it through a similar type resistor by which VBE and deltaVBE current has been generated. The minimum voltage supply (Vdd) required to operate the Banba bandgap architecture is VBE+Vdsat. For example, when the bipolar transistor has a VBE of 0.8V and the PMOS control transistor has a Vdsat of 0.1V, the minimum operating Vdd is approximately 0.9V.

However, the Banba bandgap architecture operates with higher inaccuracies that result from the current mirroring used to generate the reference voltage. Further, such inaccuracies progressively become even greater as the Vdsat is decreased and as increasingly deeper sub-micron processes are used. The Banba bandgap architecture also has multiple operating points and might not reach a correct operating point without additional control circuitry.

Figure 3:
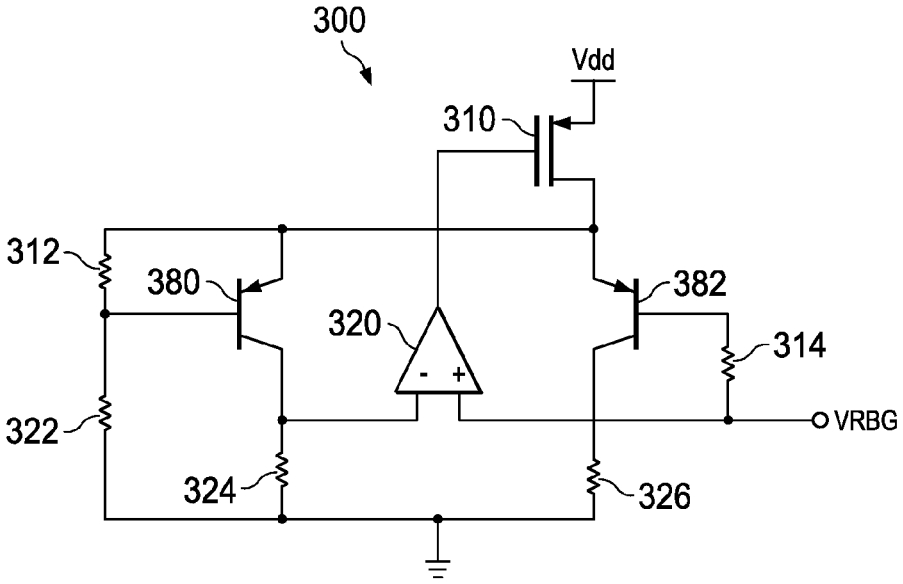
FIG. 3 (PRIOR ART)
FIG. 3 is a schematic of a bandgap circuit 300.

FIG. 3 is a schematic of a bandgap circuit 300. The bandgap circuit 300 is described by U.S. Pat. No. 7,411,443, which is hereby fully incorporated herein by reference for all purposes. The bandgap circuit 300 includes PMOS transistor 310, resistors 312, 314, 322, 324, and 326, operational amplifier 320, and bipolar transistors 380 and 382. In circuit 300, a VBE and a correct fraction of VBE (e.g., 1/m*VBE) are generated at the emitter of bipolar junction transistor 380. The VBE of transistor 382 is subtracted from this voltage to yield a deltaVBE+1/m*VBE value such that the temperature coefficients of the delta VBE signal and the fractional VBE signal cancel. The minimum voltage supply (Vdd) required to operate the circuit 300 is VRBG+VBE+Vdsat. For example, when the VRGB is approximately 0.18V, the bipolar transistor has a VBE of 0.8V and the PMOS control transistor has a Vdsat of 0.1V, the minimum operating Vdd is approximately 1.08V.

However, the circuit 300 is normally limited to generating a bandgap reference voltage (e.g., VRBG) of approximately 0.18V. Further, the circuit 300 does not function using substrate PNP bipolar junction transistors where the collector terminals are by default coupled to the substrate. The circuit 300 also has multiple operating points and might not reach a correct operating point without additional control circuitry.

Figure 4:
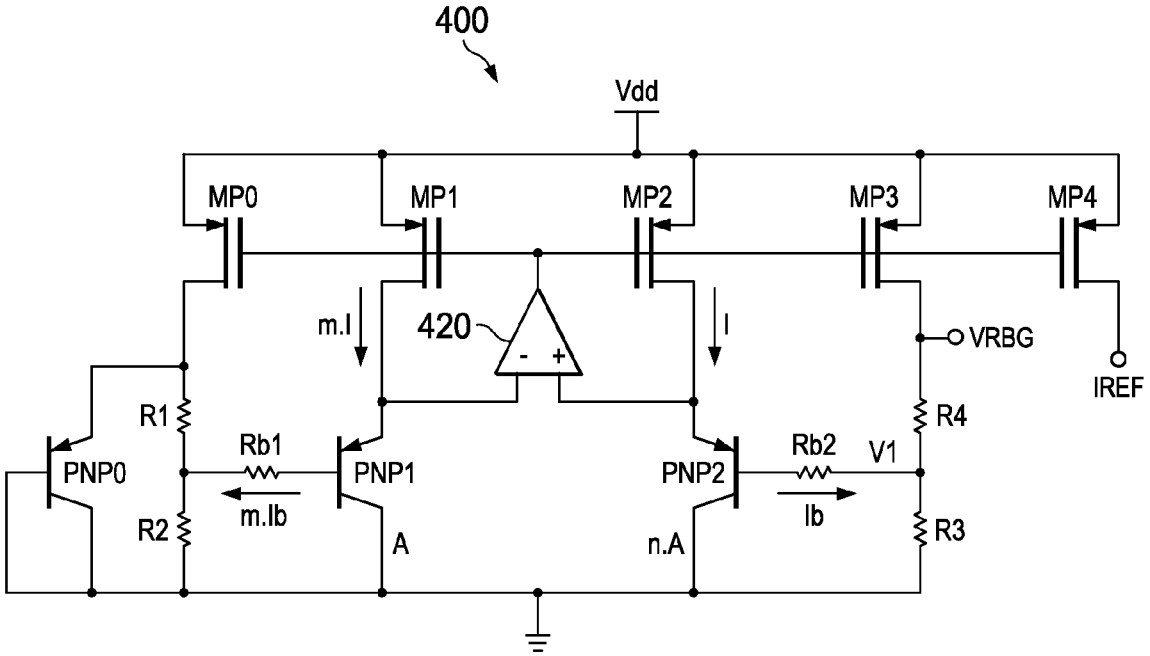
FIG. 4 is a schematic diagram of low supply voltage bandgap generator in accordance with example embodiments of the disclosure

FIG. 4 is a schematic diagram of low supply voltage bandgap generator in accordance with example embodiments of the disclosure. The circuit 400 is an example embodiment of the LSV bandgap generator 138 of FIG. 1. Generally described, the circuit 400 includes PMOS transistors MP0, MP1, MP2, MP3, and MP4, resistors R1, R2, R3, R4, Rb1, and Rb2, operational amplifier 420, and bipolar transistors PNP0, PNP1, and PNP2. The circuit 400 is optionally formed in a substrate that does not (e.g., typically) support deep N-well formation. For example, each of the bipolar transistors PNP0, PNP1, and PNP2 are substrate PNP bipolar junction transistor that includes a collector coupled to a ground (e.g., voltage potential) structure formed in the (e.g., same) substrate. The substrate PNP bipolar junction transistors are typically the only bipolar transistors available in processes that do not support a deep N well formation.

In operation, circuit 400 generates a temperature-compensated bandgap reference voltage (VRBG) by adding a fractional VBE signal (e.g., divided from the emitter of transistor PNP0) to a delta VBE signal (e.g. generated from transistors PNP1 and PNP2, each of which is biased to have a different current density) such that the temperature coefficients of the delta VBE signal and the fractional VBE signal cancels. Such a reference voltage is generated at the base of PNP2 (e.g. V1, if drop across Rb2 is neglected). The minimum voltage supply (Vdd) required to operate the circuit 400 is V1+VBE+Vdsat. For example, when the voltage of node V1 is approximately 0.18V, the bipolar transistor has a maximum VBE of 0.8V and the PMOS control transistor has a Vdsat of 0.1V, the minimum operating Vdd is approximately 1.08V.

Transistors MP0, MP1, MP2, MP3, and MP4 are each operable to provide an operating current in response to an output of an operational amplifier 420. Transistor PNP1 has an emitter area of A, whereas transistor PNP2 has an emitter area that is larger (e.g., an integer multiple N larger) than A. Transistor MP1 generates a current (m*I) that is a multiple (m) of the current generated by the transistor MP2 such that transistor PNP1 is biased using an overall higher current per unit emitter area than the current per unit emitter area used to bias transistor PNP2. The operational amplifier 420 is operable to force the emitter voltage of transistor PNP1 to be equal to the emitter voltage of PNP2. Accordingly, the reference voltage V1, which is developed at the base of transistor PNP2 (neglecting the drop across Rb2), is temperature compensated.

The transistor PNP0 has a collector coupled (e.g., connected) to its base. The transistor PNP0 has a base-to-emitter voltage (VBE0) as described below. Resistors R1 and R2 (where R1 is "high-side" resistor and R2 is the "low-side" resistor) are arranged in series (e.g., where a first terminal of R1 is coupled to the emitter of PNP0) to form a voltage divider operable to generate the fractional VBE voltage. The resistor Rb1 is coupled to the middle of the voltage divider (e.g., to the node between R1 and R2). The current through resistor Rb1 is operable to offset any error resulting from the finite base current of the bipolar transistor PNP1.

As discussed above, the transistor PNP1 is biased using a higher current per unit emitter area than the current per unit emitter area of transistor PNP2. Accordingly, the base-to-emitter voltage of PNP1 (VBE1) is higher than the VBE of transistor PNP2 (VBE2). The operational amplifier 420 forces the emitter voltage of transistor PNP2 to be equal to the emitter voltage of transistor PNP1. Accordingly, the voltage at the base of transistor PNP1 is higher than the base voltage of transistor PNP2 by VBE1−VBE2 ("delta VBE"). The delta VBE quantity is added to the fractional VBE generated by R1 and R2 voltage divider.

The operational amplifier 420 forces the emitter voltage of PNP1 and PNP2 to be equal by injecting current through transistor MP3 and into resistor R3 until the reverse bandgap voltage V1 is developed across the resistor R3 (which is the low-side resistor). The resistor Rb2 is coupled to the non-ground terminal of resistor R3 to cancel the error caused by finite base current of bipolar transistor PNP2.

Selecting the resistance value of R4 (which is the high side resistor) allows the output voltage developed across R3 (e.g., in an embodiment) to be amplified to higher voltages (for example, the output voltage can be higher than the reverse bandgap voltage generated by the circuit as described in FIG. 3). In various embodiments, the amplified bandgap reference voltage can be nearly as high as the minimum supply voltage minus the source to drain voltage (Vdsat) required by transistor MP3 to be in current saturation. Accordingly, adjusting the ratio of the voltage divider formed by R4 and R3 causes the possible amplified voltage range of VRBG to vary from V1 to the operating voltage minus the Vdsat of transistor MP3. Resistor R4 can optionally be zero ohms (e.g., not included per se in the circuit).

Transistors MP0, MP1, MP2, MP3, and MP4 are matched current mirror transistors. The amount of current flowing through the current mirror transistors is determined, for example, approximately by voltage V1 divided by resistor R3 flowing thru transistor MP3 (in this example, the base current is considered to be negligible). The transistor MP0 is operable to provide an operating current to the emitter of a transistor PNP0 and to a voltage divider formed by resistors R1 and R2. The transistor MP1 is operable to provide an operating current to the emitter of the transistor PNP1. The transistor MP2 is operable to provide an operating current to the emitter of a transistor PNP2. The transistor MP4 is operable to provide a reference current, IREF to be used by other circuits in the system (e.g., a processor that is arranged to select an operating mode in response to a comparison of an operating parameter signal with a voltage produced by the reference current or to be used as biasing current for various other types of circuits).

In accordance with Kirchhoff's circuit laws, the voltage at the negative input terminal of operational amplifier 420 is:

$$VBE0\frac{R2}{R1+R2}+m*Ib*(R1\parallel R2)+m*Ib*Rb1+VBE1+Voff \tag{1}$$

where Voff is the input referred offset voltage of operational amplifier 420. Further, the voltage at positive input terminal of amplifier 420 is:

$$VBE2+Ib*Rb2+V1 \tag{2}$$

where V1 is the voltage generated across resistor R3 and where V1 is stabilized by the feedback loop-arrangement of the operational amplifier 420.

Equations (1) and (2) are equal due to the error correction signal generated by the operational amplifier 420. Combining Eq. 1 and 2 yields:

$$\begin{cases} VBE0\frac{R2}{R1+R2}+m*Ib*(R1\parallel R2)+m*Ib*Rb1+VBE1+Voff= \\ VBE2+Ib*Rb2+V1 \end{cases} \tag{3}$$

Expressed in terms of Vrbg (and substituting in terms of R4/R3 for V1):

$$Vrbg=\begin{cases} \left(VBE0\frac{R2}{R1+R2}+dVBE\right)\left(1+\frac{R4}{R3}\right)+ \\ Voff\left(1+\frac{R4}{R3}\right)+ \\ Ib\left[m*(R1\parallel R2+Rb1)*\left(1+\frac{R4}{R3}\right)-Rb2*\left(1+\frac{R4}{R3}\right)-R4\right] \end{cases} \tag{4}$$

In the above equation (4), the first part is the required bandgap voltage. The second part is the error due to input referred offset voltage of the amplifier 420, which can be removed by either using a one-time trimming of this error or by using dynamic offset cancellation methods. The third part of the equation (4) is the error due to the finite base current. The finite base current can be negated by choosing optimum values for resistors Rb1 and Rb2.

Figure 5:
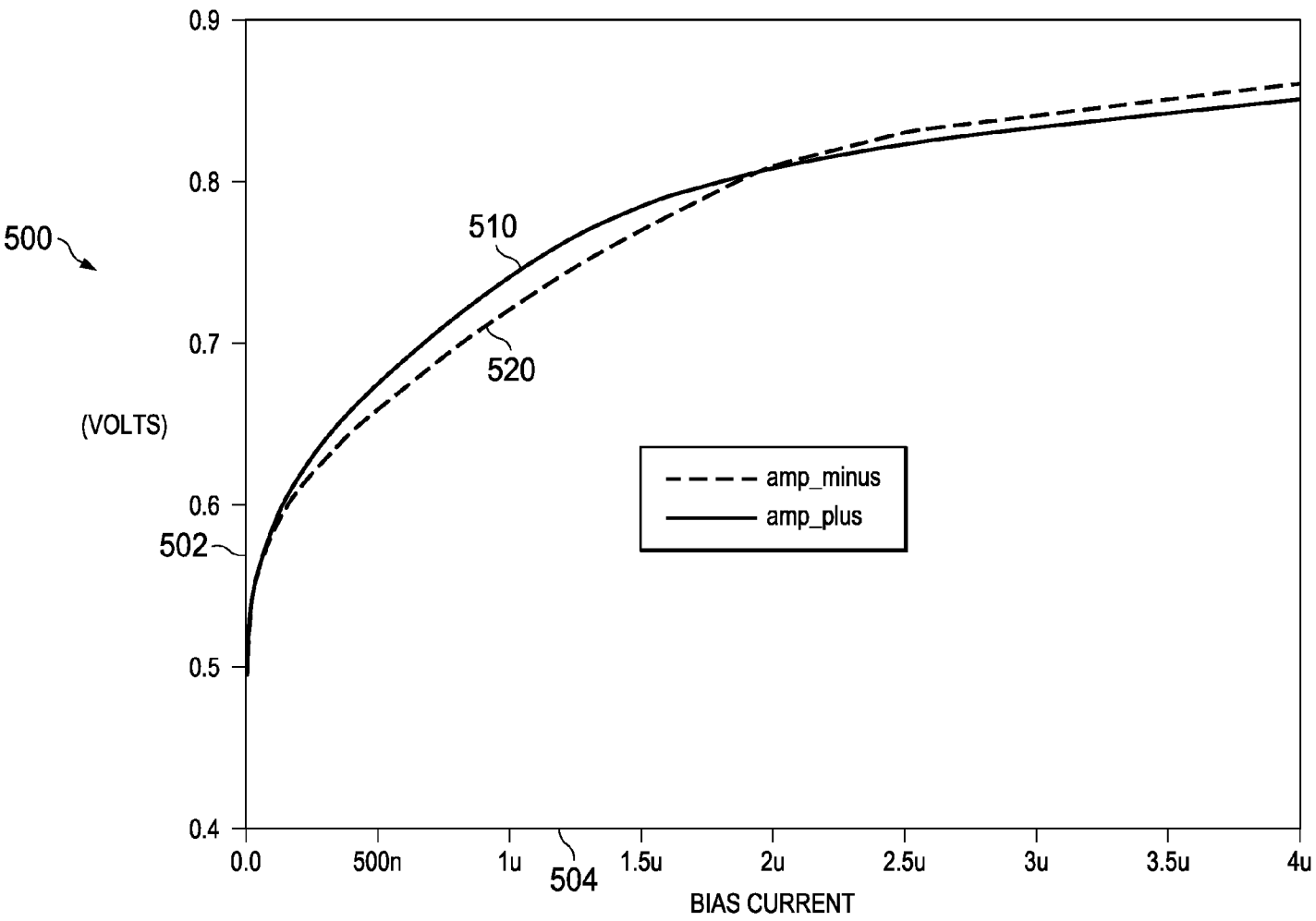
FIG. 5 is a waveform diagram illustrating equalization of the emitter voltages of two bipolar junction transistors by controlling bias currents sourced by PMOS current mirrors in accordance with example embodiments of the disclosure.

FIG. 5 is a waveform diagram illustrating equalization of the emitter voltages of two bipolar junction transistors by controlling bias currents sourced by PMOS current mirrors in accordance with example embodiments of the disclosure. Generally described, waveform diagram 500 illustrates a waveform 510 of the non-inverting input of the operational amplifier 420 (ampplus) and a waveform 520 of the inverting input of the operational amplifier 420 (amp-minus) of a low supply voltage bandgap generator operation. The axis 502 represents voltage and the axis 504 represents bias current. The waveform 510 illustrates that the operational amplifier 420 can stabilize the circuit (when both the inputs of the amplifier are equal) at Bias Current=0 uA or at 2 uA. Because only two operating points are possible, the complexity of making this circuit operational without the need of intricate startup circuits is substantially reduced.

In an embodiment, a controller (e.g., such as a microcontroller or a digital signal processor) is used to control one or more attributes of the LSV bandgap generator 138 and other system level controlled variables such as power mode selection and power mode transitioning. Some of the variables are software programmable, which allows more flexibility for implementing the disclosed control schemes and provides an enhanced ability to adaptively adjust to dynamically changing conditions for optimized system performance. Other variables can be programmed during the manufacturing process (e.g., to compensate for lot characteristics) by trimming trim-able resistors to increase operational stability and accuracy in measuring signals that provide indications of dynamically changing operating conditions.

In various embodiments, the above described components can be implemented in hardware or software, internally or externally, and share functionality with other modules and components as illustrated herein. For example, the processing and memory portions of the LSV bandgap generator 138 can be implemented outside of a device and/or substrate upon which the power converter is formed.

The various embodiments described above are provided by way of illustration only and should not be construed to limit the claims attached hereto. Those skilled in the art will readily recognize various modifications and changes that could be made without following the example embodiments and applications illustrated and described herein, and without departing from the true spirit and scope of the following claims.

What is claimed is:

1. A bandgap voltage circuit comprising:

(a) a source lead and a ground lead;

(b) a first resistor, a first node, and a second resistor coupled in series between the source lead and the ground lead;

(c) a bandgap reference voltage output, a third resistor, a second node, and a fourth resistor coupled in series between the source lead and the ground lead;

(d) a first transistor having an emitter and collector connected in parallel with the first resistor, the first node, and the second resistor, and coupled between the source lead and the ground lead, the first transistor having a base connected to the collector;

(e) a second transistor having an emitter and collector coupled between the source lead and the ground lead and having a base coupled to the first node;

(f) a third transistor having an emitter and collector coupled between the source lead and the ground lead and having a base coupled to the second node; and (g) a comparator having a first input connected to the emitter of the second transistor, a second input connected to the emitter of the third transistor, and an output.

2. The circuit of claim 1 in which the collectors of the first, second and third transistors are connected together to the ground lead.

3. The circuit of claim 1 including a fifth resistor connecting the emitter of the second transistor to the first node.

4. The circuit of claim 1 including a sixth resistor connecting the emitter of the third transistor to the second node.

5. The circuit of claim 1 including matched current mirror transistors separately coupling the source lead to the first resistor, the bandgap reference voltage output, the emitters of the first, second, and third transistors, and having control inputs connected to the output of the comparator.

6. The circuit of claim 1 in which the second transistor has an emitter area of A and the third transistor has an emitter area that is larger than A.

7. The circuit of claim 1 in which a minimum operating voltage of the circuit is determined in accordance with an equation V1+VBE+Vdsat, where V1 is a first reference voltage at the second node, VBE (voltage base-to-emitter) is a voltage generated at the emitter of the third transistor with respect to its base, and Vdsat is a minimum source to drain voltage at a current mirror transistor coupled to the emitter of the second transistor while operating in a current saturation region.

8. The circuit of claim 1 including a computing device having a lead coupled to the bandgap reference voltage output.

9. A process of producing a bandgap reference voltage comprising:

(a) generating a fractional base emitter voltage at a first center node of a first voltage divider formed of two series connected resistors connected in parallel with an emitter and collector of a first transistor;

(b) biasing an emitter of a second transistor, having an emitter area A and a base coupled to the first center node, and an emitter of a third transistor, having an emitter area greater than A and a base, to be at equal voltages to produce a difference in base-to-emitter voltages of the second and third transistors; and (c) producing the bandgap reference voltage at a top node of a second voltage divider having a second center node coupled to the base of the third transistor.

10. The process of claim 9 including coupling the first and second voltage dividers and the second and third transistors to a source lead with matched current mirror transistors.

11. The process of claim 9 in which the biasing includes comparing the emitter voltages of the second and third transistors and controlling matched current mirror transistors to provide the equal voltages to the emitters of the second and third transistors.

* * * * *